US006293402B1

(12) United States Patent
Rogers et al.

(10) Patent No.: US 6,293,402 B1
(45) Date of Patent: Sep. 25, 2001

(54) SACHET WITH INCREASED CONTENT QUANTITY

(75) Inventors: Neil John Rogers, Brussels; Joseph Fernand Deflander, Wespelaar, both of (BE)

(73) Assignee: The Procter Gamble & Company, Cincinnati, OH (US)

( * ) Notice: Subject to any disclaimer, the term of this patent is extended or adjusted under 35 U.S.C. 154(b) by 0 days.

(21) Appl. No.: 09/509,356

(22) PCT Filed: Sep. 22, 1998

(86) PCT No.: PCT/IB98/01462

§ 371 Date: Mar. 23, 2000

§ 102(e) Date: Mar. 23, 2000

(87) PCT Pub. No.: WO99/16681

PCT Pub. Date: Apr. 8, 1999

(30) Foreign Application Priority Data

Sep. 27, 1997 (EP) ..... 97202969

(51) Int. Cl.[7] ..... B65D 73/00

(52) U.S. Cl. ..... 206/484; 53/452; 53/469; 53/479

(58) Field of Search ..... 206/484; 53/452, 53/455, 469, 479

(56) References Cited

U.S. PATENT DOCUMENTS

| | | | | |
|---|---|---|---|---|
| 5,782,344 | * | 7/1998 | Edwards et al. | 206/217 |
| 5,962,092 | * | 10/1999 | Kuo et al. | 53/455 |
| 6,015,235 | * | 1/2000 | Kraimer et al. | 383/109 |
| 6,063,462 | * | 5/2000 | Tsukamoto et al. | 428/36.7 |

* cited by examiner

*Primary Examiner*—David T. Fidei
(74) *Attorney, Agent, or Firm*—James C. Vago; Jerry J. Yetter; Thibault Fayette

(57) ABSTRACT

The present invention relates to a process for producing a four sided seal sachet (10) filled with a pre-set volume of flowable material, the sachet being made from a flexible film comprising a metallocene catalysed resin, the sachet having a length L (11) between transverse seals (71) and a width W (12) between longitudinal seals (70), whereby the pre-set volume of flowable material is of more than $0.525 \times W^2 \times L/\pi$, so that leak-free seals are provided.

18 Claims, 4 Drawing Sheets

SACHET WITH INCREASED CONTENT QUANTITY

TECHNICAL FIELD

The invention relates to a process for producing four sided seal sachets, and in particular four sided seal sachets made from a flexible film comprising a metallocene catalysed resin, and to sachets obtained using this process.

BACKGROUND OF THE INVENTION

Various types of packages are formed from flexible film structures and prepared with a form-fill-seal process. Such processes comprise different steps allowing to prepare leak-free formed packages in a cost effective manner. A traditional process could be described in three successive steps, in which the package is firstly formed from the film structure, after which it is filled and finally sealed or closed. Past improvements were mostly concerned with increasing the speed of the existing processes.

A way to optimise sealing or closing speed is known from WO9500587 published on the Jan. 5, 1995. The improvement is not achieved through a modification of the process but through a modification of the sealing materials, when metallocene catalysed polyolefins are used as a sealant layer. The advantage of this type of material is its low melting temperature. In case of heat sealing methods, there is a temperature range above which the seal would be burnt and below which the seal would not be sufficiently strong. For this reason, use of metallocene catalysed polyolefins as a sealant layer allows an enlargement of the sealing range because the bottom limit of the range, called the hot tack seal initiation temperature, is brought down as metallocene catalysed polyolefins melt at lower temperature when compared to traditional polyolefins. For example, the line speed of known packaging equipment used for manufacturing sachets such as form, fill and seal machines, is limited by the sealing properties of the traditional polyolefin films used in the machines. Traditional films have high hot tack seal initiation temperatures and a narrow sealing range. Therefore, the rate at which a form, fill and seal machine can produce sachets is limited. If the heat seal temperature range where one could obtain strong seals is broadened, then the speed of a form, fill and seal machine can be increased and, thus, the rate at which sachets can be produced can be increased. This improvement introduced by WO9500587 is quantitative as it allows an increased processing speed to be applied to known processes, such as those described in U.S. Pat. No. 4,521,437.

The present invention relates to a process for producing a four sided seal sachet filled with a volume of flowable material, the process comprising at least three steps, the first step consisting of forming the sachet, the second step consisting of filling the formed sachet with the volume of flowable material and the third step consisting of closing the filled sachet, the sachet being made of a flexible film, the flexible film comprising a metallocene catalysed resin, the formed sachet having a rectangular shape with a length L (11) and a width W (12) in between seals.

The present invention also encompasses a sachet filled with a volume of flowable material, the sachet being made of a flexible film, the flexible film comprising a metallocene catalysed resin, the sachet being a four sided seal sachet (10) having two longitudinal seals (70) and two transversal seals, each of the longitudinal seals (70) intersecting both of the transversal seals at substantially right angle, the longitudinal segment comprised between the intersections having a length L, the transverse segment comprised between the intersections having a length W.

This improvement is applied to a well known sealing process described in U.S. Pat. No. 4,521,437, patented on the Jun. 4, 1985, which can be made on a so-called vertical form and fill machine. Using such a machine, a flat web of synthetic thermoplastic film is unwound from a roll and formed into a continuous tube in a tube forming section, by sealing the longitudinal edges on the film together to form a so-called lap seal or a so-called fin seal (70). The tube thus formed is pulled vertically downwards to a filling station. The tube is then collapsed across a transverse cross-section of the tube, the position of such cross-section being at a sealing device below the filling station. A transverse heat seal is made (71), by the sealing device, at the collapsed portion of the tube, thus making an air tight seal across the tube. The sealing device generally comprises a pair of jaws. After making the transverse seal (71), a pre-set volume of material to be packaged, e.g. flowable material (80), is allowed to enter the tube, at the filling station, and fill the tube upwardly from the aforementioned transverse seal (71). The tube is then allowed to drop a predetermined distance under the influence of the weight of the material in the tube and of the film advance mechanism on the machine. The jaws of the sealing device are closed again, thus collapsing the tube at a second transverse section, which is above the air/material interface in the tube. The sealing device seals and severs the tube transversely at said second transverse section (90). The material-filled portion of the tube is now in the form of a pillow shaped sachet. Thus the sealing device has sealed the top of the filled sachet (91), sealed the bottom of the next-to-be-formed sachet (92) and separated the filled sachet from the next-to-be-formed sachet, all in one operation.

The existing processes described in U.S. Pat. No. 4,521,437 aims to avoid what is called contamination of the sealing regions. Contamination occurs when the contained material enters the sealing region to seal prior or/and during the sealing operation. Contamination becomes particularly frequent as the package size reduces, because the level of the contained product is closer to the sealing region. Therefore, there is a chance that product can enter the seal region due to splashing or foaming (for liquid products), or because of bouncing and shaking (for powder products). In some cases, particularly concerning liquids or powders containing a high level of surfactants, this can lead to poor seal quality and to product leakage. For powder, the fine granules within the powder can prevent the flow of the sealing material in the seal region from contacting the seal surfaces. For the liquid, especially if viscous or if containing surfactants, the liquid can be difficult to squeeze out during the seal process because it can wet the region within the seal. Both these examples can result in lower seal strength or, in extreme situations, no seal at all.

Consequently, the contamination has to be prevented. In order to prevent contamination, the pre-set volume of material to be packaged is reduced so that the air/material interface is brought down to a level at which contamination does not occur, after what sealing is made above the air/material interface as described in U.S. Pat. No. 4,521,437. Sealing can then be made in a faster and more reliable manner as the seal region is not contaminated. The disadvantage is that the volume availabe in the package is not used to maximum capacity, so that part of the package material is wasted.

The present invention is aiming at increasing the pre-set volume of flowable material contained in a four sided seal sachet by sealing through partial or complete contamination instead of avoiding contamination. The aim is to render it possible to seal through flowable materials, so that the packing process can be redesigned in a more efficient manner.

SUMMARY OF THE INVENTION

The present invention provides a package as well as a process in a manner to satisfy the aforementioned needs.

The process of the invention is characterised in that the volume of flowable material is at least of $0.525 \times W^2 \times L/\pi$.

In another aspect of the invention, a sachet filled with a volume of flowable material is provided, characterised in that the volume of flowable material is at least of $0.525 \times W^2 \times L/\pi$.

DETAILED DESCRIPTION OF THE INVENTION

The invention will now be described by way of example and with reference to the accompanying drawings in which:

FIG. 1 is a front view of a sachet in accordance with the present invention.

FIG. 2 schematically illustrates a traditional transverse structure of flexible film used for a sheet.

FIG. 3 schematically illustrates four examples of transverse structures of flexible film for a sachet according to the present invention.

FIG. 4 is a front view of a sachet in accordance with the present invention.

FIG. 5 schematically illustrates a traditional transverse structure of flexible film used for a sachet.

FIG. 6 schematically illustrates two examples of transverse structures of flexible film for a sachet according to the present invention.

Figure 1:
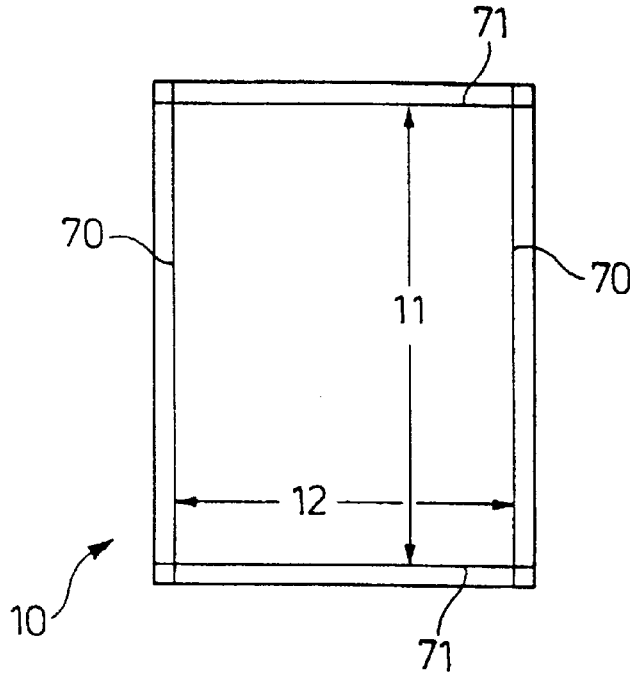

The process of the invention is used for producing a four sided seal sachet (10) filled with a volume of flowable material. Usually, a four sided seal sachet comprises two longitudinal seals (70) and two transverse seals (71). Normally, three of these seals are sealed during the forming step of the production process. Typically, these three seals are the longitudinal seals (70) and one transverse seal (71). This means that following the forming step, the sachet is usually left with one opened side. Filling should consequently occur through this opened side. During the filling step, a pre-set volume of material is inserted within the sachet. According to the invention, the pre-set volume of flowable material can be determined using the basic geometric characteristics of the sachet.

These characteristics are the longitudinal usable distance L (11) and the transversal usable distance W. This means that if a sachet is empty and laid flat, L (11) is the longitudinal distance taken from one transverse seal (71) to the other. L (11) is said as "usable" because it corresponds to the unsealed distance between two seals, so that it corresponds to the space which can be effectively filled with flowable material. Similarly, the distance W (12) corresponds to the usable transversal distance between the two longitudinal seals (70).

The pre-set volume according to the invention is of at least $0.525 \times W^2 \times L/\pi$. Indeed a four sided seal sachet made of a flexible film which would not comprise a metallocene catalysed resin could not be filled with such a volume as it would involve the risk of breaking the seal due to contamination, whereas this does not occur if the flexible film comprises a metallocene made resin. Indeed, using metallocene made resins allows not only to get a better quality sealing but also to reach higher levels of filling. The pre-set volume according to the invention is preferably of less than $0.75 \times W^2 \times L/\pi$, more preferably of less than $0.725 \times W^2 \times L/\pi$, most preferably of less than $0.7 \times W^2 \times L/\pi$. This upper limit corresponds to full contamination for a sachet having a normal flexibility, which means that there is no head space in the sachet once fill re limit is due to the limited flexibility and extensibility of a normal flexible film used for forming the sachet.

It should be noted that once it is filled, a four sided seal sachet has a pillow shape, so that the length L (11) of the sachet and the width W (12) are not anymore straight lines as they follow the contour of the pillow shaped sachet.

Filling a four sided seal sachet with the pre-set volume of flowable material according to the present invention preferably applies to a sachet having L (11) comprised between 100 and 280 mm and W (12) comprised between 35 and 150 mm. More preferably, the present application applies to a sachet having L (11) comprised between 110 and 200 mm and W (12) comprised between 40 and 120 mm. Even more preferably, the present application applies to a sachet having L (11) comprised between 130 and 180 mm and W (12) comprised between 50 and 100 mm. Indeed, the improvement according to the invention is more significant for a smaller size of sachet because contamination is more likely to occur in such a case, as the ratio of the seal surface to the volume contained is reduced for bigger sizes of sachets, so that contamination is not so critical. Furthermore, it is preferred that LAN is comprised between 1.5 and 5, more preferably between 1.75 and 4, even more preferably between 2 and 3.5, and most preferably between 2 and 3. Indeed, a sachet having an elongated shape, for example L=10.W, will have reduced contamination problems as the transversal seal which is sealed for closing has a length of the order of the width of the sachet W (12) which will be small compared to the volume of flowable material which can be filled in the sachet, when compared to sachets which are not so elongated. It should be noted that the range of sachets to which the invention preferably applies is a range which is widely used for packaging of consumer products. The process also preferably applies to a sachet made from a flexible film having a tensile modulus between 50 MPa and 2000 MPa, more preferably between 100 MPa and 1000 MPa, most preferably between 200 MPa and 500 MPa. Indeed, a sachet made of a rigid film cannot be filled and a sachet made from a too flexible film would be difficult to process and likely to burst easily. It is also preferred that the sachet is made at a speed between 20 and 100 cycles/minute, more preferably at a speed between 40 and 80 cycles/minute, and most preferably at a speed between 50 and 70 cycles/minute, on a traditional form/ fill/ seal machine, in order to control the production costs while obtaining good quality filled sachets containing the pre-set volume of flowable material.

The seals are normally formed by sealing together opposing surfaces of flexible film, the flexible film comprising a sealing layer in a sealing region, whereby the sealing layer usually comprises the metallocene catalysed resin, the sealing region being normally partially or fully covered with the flowable material prior to and during the sealing step as contamination occurs.

The flexible film may comprise a dedicated sealing layer comprising a metallocene catalysed resin. By "metallocene catalysed resin" it is to be understood herein that all different types of metallocene catalysed resins well known in the art, including metallocene catalysed polyolefine copolymers having olefinic monomers such as ethylene, propylene, butene, and the like, are suitable. Preferred herein are metallocene catalysed polyethylenes. Such polyethylenes are known to those skilled in the art, for example XU 59900.02 or XU 59900.17 are commercially available from Dow. Such a sealing layer particularly applies to the invention as metallocene based resins are allowing to overcome contamination. The metallocene made resin may be used as either a complete film or as a sealant layer to provide the benefits of the invention. When the metallocene made resin is used as a sealant layer, any other additional layers can be added on top of this layer.

The flexible film is either a blended or/and a laminated or/and a co-extruded or/and a single layer film. Preferred herein are laminated films comprising a polyethylene terephthalate layer, an other layer comprising linear low density polyethylene, low density polyethylene or linear low density polyethylene or a mixture thereof having a thickness comprised between 70 and 170 $\mu$m and at least one sealant layer comprising metallocene catalysed polyethylene and having a thickness comprised between 20 and 100 $\mu$m. Another preferred film is a co-extruded film comprising a 20 $\mu$m thick layer formed of low density polyethylene, an other 40 $\mu$m thick layer formed of linear low density polyethylene-copolymer and a 20 $\mu$m thick metallocene catalysed polyethylene layer. Preferably, the flexible film used has a thickness exceeding 10 $\mu$m. Furthermore, the qualities of co-extruded films comprising metallocene made resins can be used for packages which can be easily recyclable and produced at lower costs than, for example, laminated films, such as poly vinyl chloride laminated films.

The term "flowable materials" does not include gaseous materials, but encompasses materials which are flowable under gravity or may be pumped. Such materials include liquids, pastes, gels, emulsions or powders. The invention is particularly useful for flowable materials containing surfactants, which would introduce a high failure rate in existing sealing processes when contaminating the sealing region, as they can "wet" the seal region. Such flowable materials may contain from 5 to 50% by weight of surfactants, preferably from 10 to 30% by weight of surfactants. Examples of failure are product leakage in line or after a period of time after package manufacture. The invention is also particularly useful when applied to viscous materials, for example for flowable materials with a viscosity higher than 100 mPa.s (milli Pascal second=cps in CGS system), because it is usually difficult to squeeze the flowable material out from the seal region during the sealing process.

When contamination occurs, the sealing region is at least partially covered with the flowable material prior to and during the sealing step, and is at least partially contaminated by the flowable material. The sealing region can be contaminated in different ways. For example, contamination can occur because of an increased line speed of a packaging process, whereby the flowable material contained in the packages is getting into the seal region, due to splashing or foaming. In such a case, overcoming contamination results in the possibility of increasing the line speed. Contamination can also occur when the size of the package used in traditional processes is reduced, in such a way that the air/flowable material interface is closer of the sealing region than it is when using traditional sealing processes. Full contamination occurs for instance when the air/flowable material interface is beyond the sealing region, so that the volume contained between the opposing surfaces in the sealing region is essentially filled with the flowable material prior to and during the sealing step. In such a case, overcoming contamination results in the possibility of decreasing the package size for a given amount of flowable material. In particular, when the air/flowable material interface is beyond the sealing region and contamination is overcome, the packages will not contain a gaseous phase, meaning that the flowable material will completely fill the volume available in the package so that it will form a unique phase. The flowable material phase may contain gas, as in the case of powder, but the gas is located within the flowable material phase, and does not form an independent isolated phase. Indeed, it is an object of this invention to provide packages with a reduced size for a given volume or weight of product. Additionally, it is an object of this invention to provide an ecological process for sealing whereby the package materials used can be recycled and the packages produced are used to maximum capacity, so that the amount of package material used is minimised.

Seals are provided by sealing means known to the man skilled in the art. Sealing preferably comprises the steps of applying a continuously heated element in contact with the film during sealing, and removing the element after sealing. This can be provided by a hot bar sealing element comprising jaws. In operation, the sealing jaws are closed. This allows the sealing layer to melt so as to make the seal. Other preferred sealing means include heated wheels which rotate. Generally, a physical barrier to the two sealing surfaces is created in the part of the sealing region which is contaminated. Use of metallocene catalysed resins as a sealant layer allows the sealant to flow around and/or through contamination within the seal. This provides the ability to seal through contamination. Different seal types can be used. This includes fin seals and overlap seals. For overlap seals, it is preferred that a sealant layer is also on the outside of the film so as to provide a seal layer/ seal layer seal. Use of metallocene made resins as a sealant layer can allow a greater level of over sealing during the sealing step without a loss in production times. By "over sealing" it is meant that the seal forms in a shorter time due to less heat required to melt these materials when compared with conventional sealant. This can lead to more opportunity for the sealing layers to contact and therefore seal better. In a preferred embodiment of the present invention, the film used is a co-extruded film which has a difference between the seal initial temperature of the inside of the film and the melting point of the film of more than 30 degrees Celsius. Preferably, such films should contain a polyolefin outer layer with a melting point comprised between 110 and 160 degrees Celsius as well as a metallocene made resin sealant layer with a melting point comprised between 70 an 90 degrees Celsius, and such materials should be able to be co-extruded together into this co-extruded structure. This co-extruded structure can be processed more easily on hot bar sealing equipment, without the need for an expensive lamination step, as the film can be sealed without melting the whole film. The seal initiation temperature of metallocene made resins can be significantly lower than the one of traditional materials while the upper sealing temperature at which heat would degrade the plastic can remain the same as traditional materials. Indeed, it is an object of the present invention to provide a process allowing production of filled packages at a lower cost.

The benefit of using the process of the invention is that the film package size can be reduced because the air/flowable material interface can be closer to the seal region with leak-free seal even when the flowable material enters into the sealing region and contaminates it. This is avoided in traditional processes as it would result in lower seal strength or no seal at all. Overcoming contamination can result in faster production speeds as well as reduced size packages. Speed can be increased compared to the traditional processes because the contamination produced by increased shaking, bouncing, splashing or foaming can be overcome by the process of the present invention. Indeed, it is an object of the present invention to compensate contamination while maintaining or improving the existing sealing speed of traditional processes.

Figure 2:
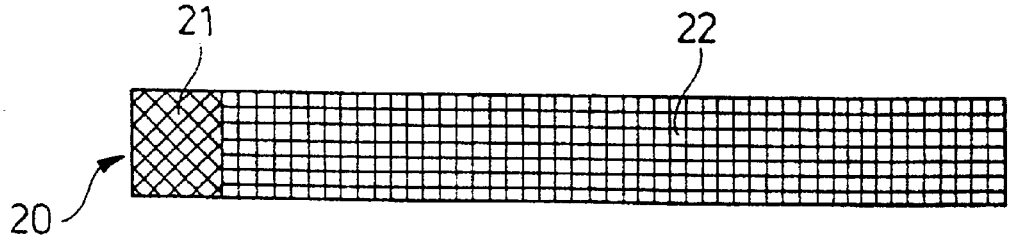
Figure 3:
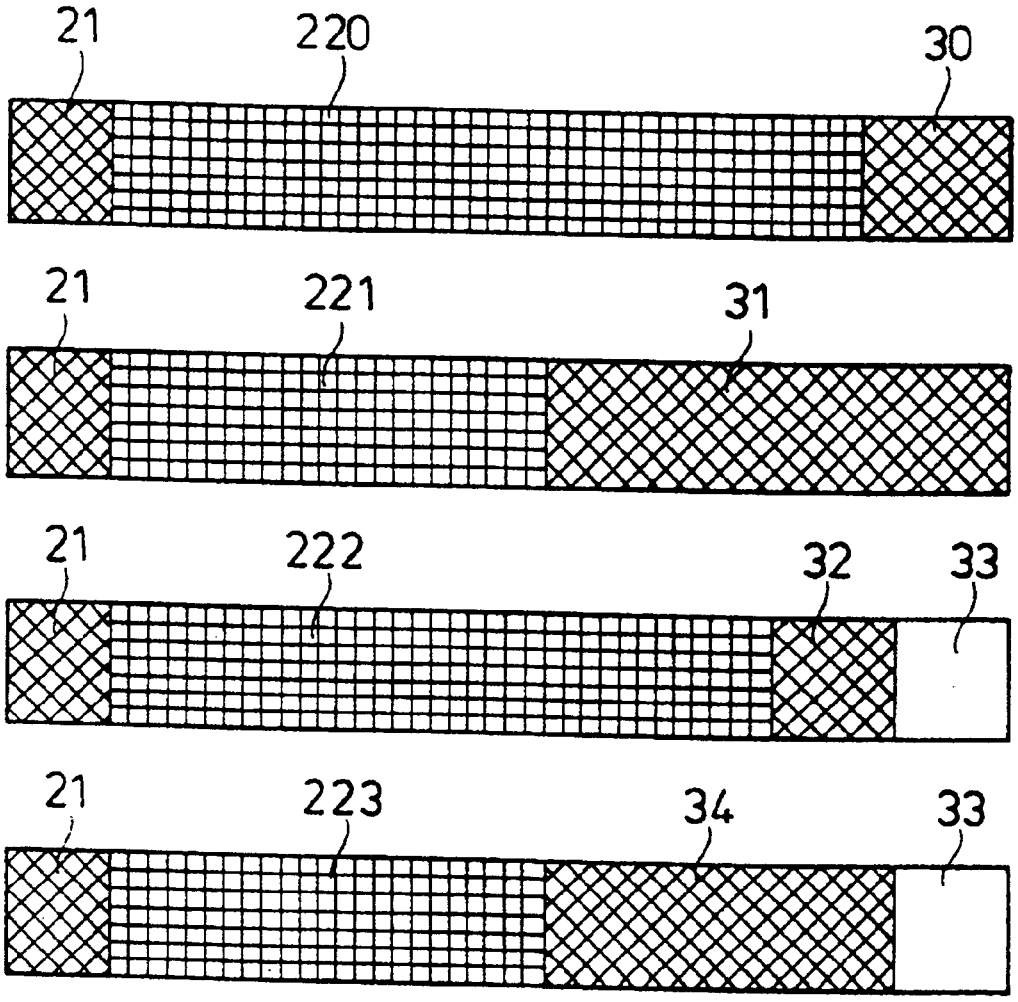

For example, a sachet according to the invention may be provided for containing a standard heavy duty liquid formulation. The film structure (20) traditionally used for this type of sachet is presented in FIG. 2. It is composed of a 12 $\mu$m standard polyethyl teraphtalate layer (21) laminated to a 180 $\mu$m low density polyethylene/linear low density polyethylene layer (22). The polyethylene provides both sealing and strength qualities while the polyethyl teraphtalate provides perfume barrier, stiffness, a glossy finish as well as protection for the inks which are sandwich printed. Different structures can be used for applying the process of the invention. All of them comprise at least a layer of metallocene based material, some preferred embodiments comprise two layers. Some possible embodiments are presented in FIG. 3. These embodiments all comprise a layer of polyethyl teraphtalate similar to the one used in the traditional films. Two grades of metallocene based resins are proposed without limitation. XU 59900.17 offers excellent puncture performance and good sealing qualities, while the XU 59900.02 grade offers excellent sealing performance. A first preferred embodiment comprises a coextruded film of 20 $\mu$m of XU 59900.17 (30) and 160 $\mu$m of low density polyethylene/linear low density polyethylene (220), which is laminated with the polyethyl teraphtalate layer (21). A second preferred embodiment comprises a co-extruded film of 90 $\mu$m of XU 59900.17 (31) and 90 $\mu$m of low density polyethylene/linear low density polyethylene, (221) which is laminated with the polyethyl teraphtalate layer (21). A third preferred embodiment comprises a co-extruded film of 20 $\mu$m of XU 59900.17 (32), 20 $\mu$m of XU 59900.02 (33) and 160 $\mu$m of low density polyethylene/linear low density polyethylene (222) blown on a standard 3 layer co-extrusion blown film line, which is laminated with the polyethyl teraphtalate layer (21). A fourth preferred embodiment comprises a co-extruded film of 80 $\mu$m of XU 59900.17 (34), 20 $\mu$m of XU 59900.02 (33) and 80 $\mu$m of low density polyethylene/linear low density polyethylene (223) blown on a standard 3 layer coextrusion blown film line, which is laminated with the polyethyl teraphtalate layer (21). Such a sachet has been sealed using a hot bar sealing unit run at different temperatures and seal times. The seal jaw profile is a 2×2 mm wide seal jaw. The film tested bum above a sealing temperature of 235 degrees Celsius. Using a traditional sealing process and traditional sealing materials, the sachet filled with flowable materials has a functional seal only for temperatures above 165 degrees for a sealing time a seal time of 0.8 s. When using metallocene made resins as a sealant layer in the process of the invention, and when the sachet is filled with more flowable material, which represents full or partial contamination of the sealing region, i.e. with the pre-set volume of material of at least $0.525\times W^2\times L/\pi$, the speed can be increased up to 0.55 s sealing time while maintaining the same temperature. More preferably, the pre-set volume of flowable material is of at least $0.55\times W^2\times L/\pi$, even more preferably the pre-set volume is of more than $0.6\times W^2\times L/\pi$. In fact the pre-set volume of flowable material can be chosen within such limits depending on the desired speed of production of the sachet, depending on the particular flexible film used and on the particular type of flowable material, and taking account of practical use of the sachet by the user. Indeed, it may not be desirable for the user to have a sachet which would be completely full, because such a sachet would leak at opening. This improvement both in filling levels and in sealing times is due to the metallocene based resins ability to seal through flowable material. Furthermore, the sealing temperature range is improved in this case by 45%. All seals were pressure tested using the on-line pressure tester and vacuum tested in a Multivac A300/16 vacuum during a time of 60 s at an external pressure of 50 mBar. All sachets were drop tested from 1 meter and 1.5 meter. There was no failure in the conditions described.

Figure 4:
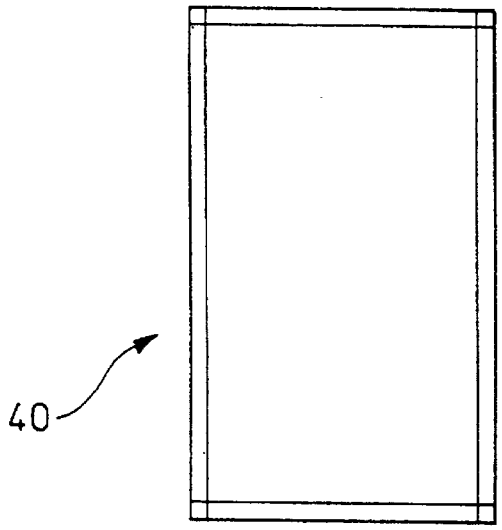
Figure 5:
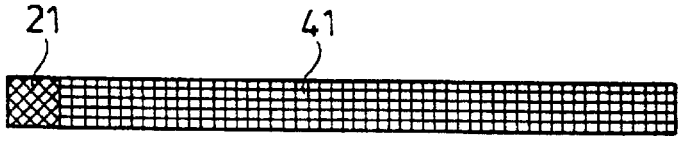
Figure 6:
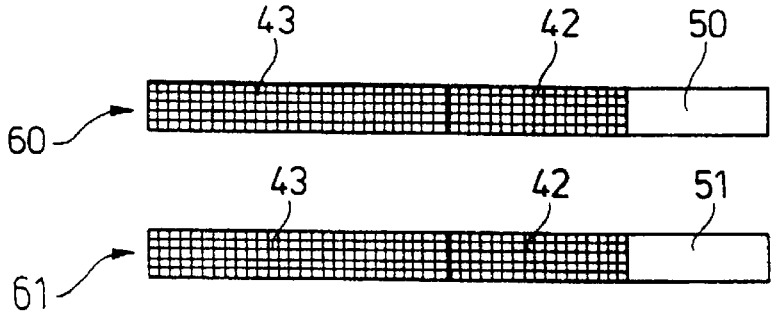

FIG. 4 presents an other preferred embodiment of the invention. It is a front view of a sachet (40) which can be sealed using the process of the invention. The sachet can be used for containing a standard concentrated light duty liquid formulation. The film structure traditionally used for this sachet is presented in FIG. 5. It is composed of a 12 $\mu$m standard polyethyl teraphtalate layer (21) laminated to a 80 $\mu$m linear low density polyethylene/medium density polyethylene/linear low density polyethylene layer (41). The polyethylene provides both sealing and strength qualities while the polyethyl teraphtalate provides perfume barrier, stiffness, a glossy finish as well as protection for the inks which are sandwich printed. Different structures can be used for applying the process of the invention. All of them comprise at least a layer of metallocene based material. Some possible embodiments are presented in FIG. 6. These embodiments do not need to comprise a layer of polyethyl teraphtalate similarto the one used in the traditional films. Two grades of metallocene based resins are proposed without limitation: XU 59900.17 and XU 59900.02. A first preferred embodiment comprises a co-extruded film (60) of 20 $\mu$m of XU 59900.02 (50), 20 $\mu$m of low density polyethylene (42) and 40 $\mu$m of linear low density polyethylene-2740 (43) blown on a standard 3 layer cextrusion blown film line. A second preferred embodiment comprises a co-extruded film (61) of 20 $\mu$m of XU 59900.17 (51), 20 $\mu$m of low density polyethylene (42) and 40 $\mu$m of linear low density polyethylene-2740 (43) blown on a standard 3 layer co-extrusion blown film line. New films proposed can be processed on the same traditional machines. Using a traditional hot bar sealing process (Seal time 0.8 s, 50 Cycles/min) and traditional sealing materials, the sachet is filled with flowable materials but with a substantial gaseous head phase, otherwise product can get into the seal, and usually cause failure. When using for example the structures of FIG. 6 in the process of the invention whereby contamination is overcome and in the same conditions (Seal time 0.8 s, 50 Cycles/min) the sachet can be filled with more flowable material, thus having a pre-set volume of flowable material of more than $0.525\times W^2\times L/\pi$ and preferably of less than $0.75\times W^2\times L/\pi$, which normally represents full or partial contamination of the sealing region.

This improvement in filling levels is due to the metallocene based resins ability to seal through flowable material. All seals were pressure tested by placing a 8 kg weight on top of the sachets for 2 hours at 50 degrees. There was no failure in the conditions described.

Figure 7:
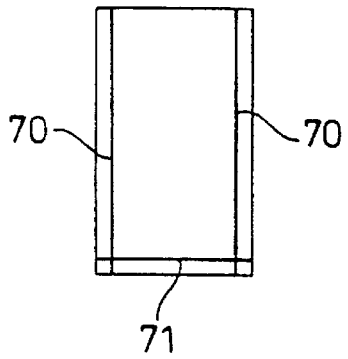
FIG. 7 is a front view of a sachet prior to the filling step and after the forming step.
Figure 8:
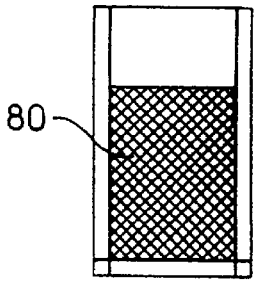
FIG. 8 is a front view of a filled package prior to the closing step.
Figure 9:
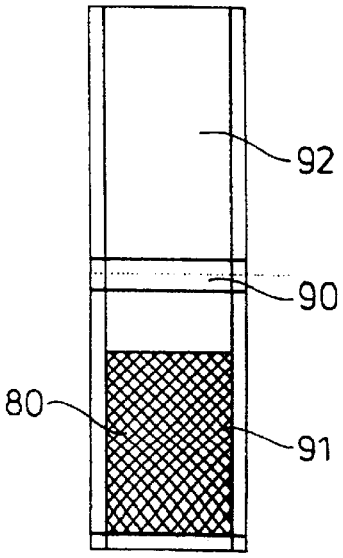
FIG. 9 is a front view of two packages, one being prior to the filling step, the other being filled and closed.

FIG. 7 represents an embodiment of a package with longitudinal (70) and transverse (71) seals. Such a package can then be filled with flowable material (80) (FIG. 8). If the process of the present invention is used, the filling level is such that contamination occurs, partially or completely, prior and/or during the sealing step in the sealing region (90) (FIG. 9). It should be noted that the filling level of flowable liquid represented on FIGS. 8 and 9 is not limiting. Indeed, contamination depends on the filling level but also on other elements like speed of process.

What is claimed is:

1. A method for producing a four sided sealed sachet filled with a volume of flowable material containing a surfactant which can contaminate said seal, said method comprising the steps of:

(a) forming a sachet;

(b) filling said formed sachet with a volume of said flowable material containing a surfactant; and (c) closing the filled sachet, wherein said sachet is made of a flexible film comprising a metallocene catalysed resin, the formed sachet having a rectangular shape when emptied with a length L and a width W in between seals and wherein the volume of flowable material is at least $0.525 \times W^2 \times L/\pi$.

2. A method of making a four sided seal sachet filled with a flowable material, said method comprising the steps of:

(a) forming a sachet with a first and a second longitudinal seal, a first transverse seal and one opening wherein said sachet is made of a flexible film, said film comprising a metallocene catalysed resin;

(b) filling said sachet through said opening with a flowable material wherein said flowable material is capable of contaminating the sealing region of a second transverse seal during the filling operation; and (c) closing said sachet with a second transverse seal such that when the sachet is empty said sachet has a substantially rectangular shape with a length L between said first and second transversal seals and a width W between said first and second longitudinal seals and wherein the volume of flowable material contained in said sachet is less than about $0.75 \times W^2 \times L/\pi$ such that said filled sachet has a pillow shape.

3. The method of claim 2 wherein said flowable material contains surfactants in a range of about 5% to about 50% by weight.

4. The method of claim 2 wherein said flowable material is a powder.

5. The method of claim 2 wherein said flowable material has a viscosity of at least 100 mPa.s.

6. The method of claim 2 wherein the volume of flowable material contained in said sachet is in a range of about $0.7 \times W^2 \times L/\pi$ to about $0.75 \times W^2 \times L/\pi$.

7. The method of claim 2 wherein said flexible film comprises a sealing layer, said sealing layer comprising a metallocene catalysed resin, and wherein said second transverse seal is formed by sealing opposing surfaces of said flexible film and said sealing region is at least partially covered by said flowable material when said opposing surfaces are sealed together.

8. The method of claim 7 wherein said sealing region is substantially covered by said flowable material when said opposing surfaces are sealed together.

9. A pillow shaped sachet filled with a volume of flowable material comprising:

a four sided seal sachet comprising a first sheet of flexible material sealably attached to a second sheet of flexible material wherein said flexible material comprises a metallocene catalysed resin, said sachet comprising a first and a second longitudinal seal and a first and a second transversal seal such that when the sachet is empty said sachet has a substantially rectangular shape with a length L between said first and second transversal seals and a width W between said first and second longitudinal seals; and a flowable material contained in said sachet wherein the volume of flowable material contained in said sachet is less than about $0.75 \times W^2 \times L/\pi$ such that said filled sachet has a pillow shape.

10. The sachet of claim 9 wherein said flowable material contains surfactants in a range of about 5% to about 50% by weight.

11. The sachet of claim 9 wherein said flowable material is a powder.

12. The sachet of claim 9 wherein said flowable material has a viscosity of at least 100 mPa.s.

13. The sachet of claim 9 where in the volume of flowable material contained in said sachet is in a range of about $0.7 \times W^2 \times L/\pi$ to about $0.75 \times W^2 \times L/\pi$.

14. The sachet of claim 9 wherein said flexible material is a multilayer material comprising at least one inner sealing layer made of metallocene catalyzed resin and at least one outer layer of material selected from the group consisting of polyethylene terephthalate, polyethyl terephthalate, linear low density polyethylene, low density polyethylene, linear low density polyethylene or any mixtures thereof.

15. The sachet of claim 9 wherein said flexible material is a multplayer material comprising a first sealing layer made of a first metallocene catalyzed resin and a second sealing layer made of second metallocene catalyzed resin and at least one layer of material selected from the group consisting of polyethylene terephthalate, polyethyl terephthalate, linear low density polyethylene, low density polyethylene, linear low density polyethylene or any mixtures thereof.

16. The sachet of claim 14 wherein said flexible material is a co-extruded film.

17. The sachet of claim 16 wherein the melting point temperature of said film is at least 30 degrees Celsius greater than the seal initial temperature of said film.

18. The sachet of claim 9 wherein the side edges of said pillow shape sachet are not straight lines when the sachet is filled.

* * * * *